US009447779B2

(12) United States Patent
Kapulkin et al.

(10) Patent No.: US 9,447,779 B2
(45) Date of Patent: Sep. 20, 2016

(54) LOW-POWER HALL THRUSTER

(76) Inventors: Alexander Kapulkin, Haifa (IL); Mauricio Moshe Guelman, Haifa (IL); Vladimir Balabanov, Haifa (IL); Binyamin Rubin, Haifa (IL)

( * ) Notice: Subject to any disclaimer, the term of this patent is extended or adjusted under 35 U.S.C. 154(b) by 1283 days.

(21) Appl. No.: 12/513,916

(22) PCT Filed: Nov. 11, 2007

(86) PCT No.: PCT/IL2007/001384

§ 371 (c)(1),
(2), (4) Date: Jan. 11, 2010

(87) PCT Pub. No.: WO2008/056369

PCT Pub. Date: May 15, 2008

(65) Prior Publication Data

US 2010/0107596 A1 May 6, 2010

Related U.S. Application Data

(60) Provisional application No. 60/865,033, filed on Nov. 9, 2006.

(51) Int. Cl.
*F03H 1/00* (2006.01)

(52) U.S. Cl.
CPC ..... *F03H 1/0075* (2013.01)

(58) Field of Classification Search
USPC ..... 60/200.1, 202, 203.1; 313/359.1, 360.1, 313/362.1; 315/111.81, 111.91
See application file for complete search history.

(56) References Cited

U.S. PATENT DOCUMENTS

| | | | | |
|---|---|---|---|---|
| 4,862,032 | A | 8/1989 | Kaufman et al. | |
| 5,581,155 | A | 12/1996 | Morozov et al. | |
| 5,646,476 | A * | 7/1997 | Aston | 313/359.1 |
| 5,859,428 | A | 1/1999 | Fruchtman | |
| 6,815,700 | B2 * | 11/2004 | Melnychuk et al. | 250/504 R |
| 6,834,492 | B2 * | 12/2004 | Hruby et al. | 60/202 |
| 6,982,520 | B1 * | 1/2006 | de Grys | 313/361.1 |
| 7,075,095 | B2 * | 7/2006 | Kornfeld et al. | 250/492.21 |

(Continued)

FOREIGN PATENT DOCUMENTS

WO WO 2008/056369 5/2008

OTHER PUBLICATIONS

International Preliminary Report on Patentability Dated May 12, 2009 From the International Bureau of WIPO Re. Application No. PCT/IL2007/001384.
International Search Report and the Written Opinion Dated Mar. 11, 2008 From the International Searching Authority Re. Application No. PCT/IL2007/001384.

(Continued)

*Primary Examiner* — Arun Goyal

(57) ABSTRACT

A low power hall thruster is provided that is effective for micro-spacecrafts and nano-spacecrafts as well as mini-spacecrafts. The hall thruster comprises a co-axial acceleration channel capable of being applied with predominantly-radial magnetic field and a co-axial anode within a cavity capable of being applied with substantially longitudinal magnetic field. A cathode-compensator is placed beyond the acceleration channel and magnetic system is provided capable of generating the radial magnetic field within the co-axial acceleration channel and the longitudinal magnetic field within the co-axial anode. An electrically isolated gas distributor is also provided.

12 Claims, 8 Drawing Sheets

(56) References Cited

U.S. PATENT DOCUMENTS

Figure 1:
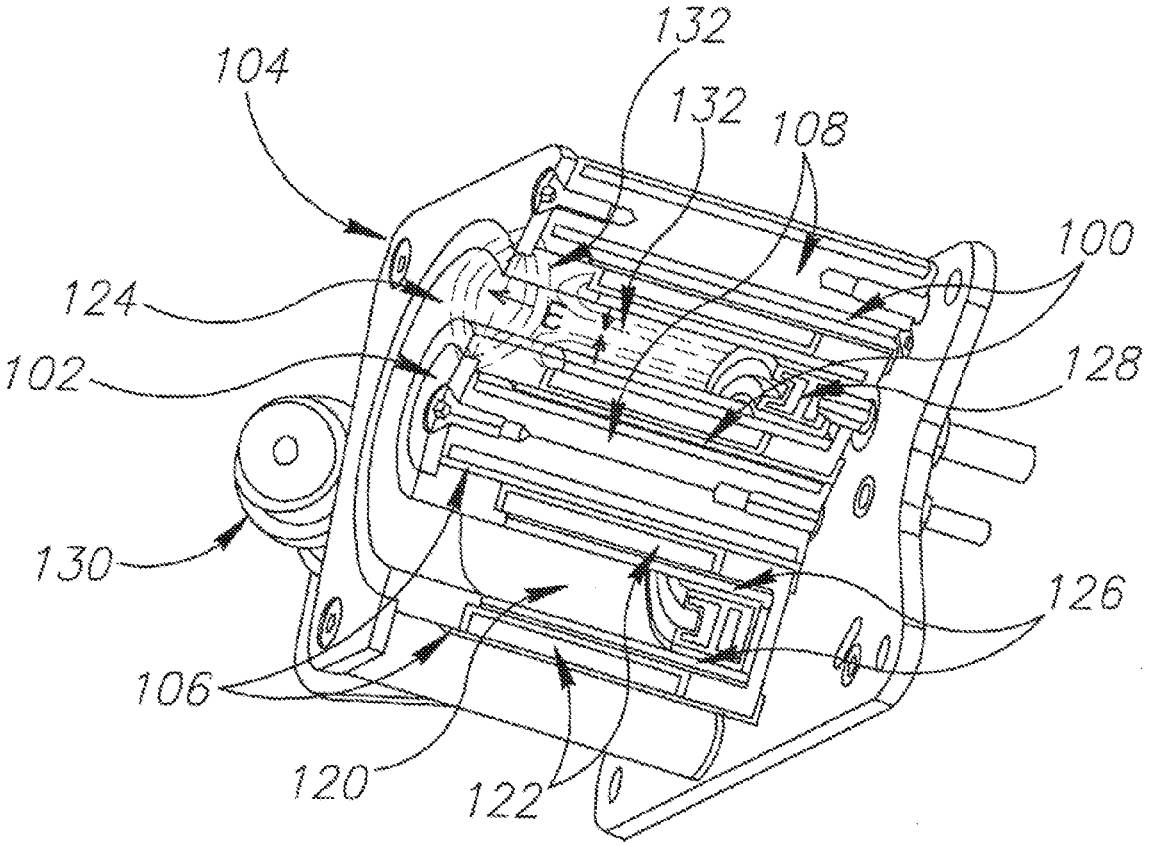

| | | | |
|---|---|---|---|
| 2002/0014845 | A1 | 2/2002 | Raitses et al. |
| 2002/0145389 | A1 | 10/2002 | Bugrova et al. |
| 2005/0174063 | A1 | 8/2005 | Kornfeld et al. |
| 2006/0076872 | A1 | 4/2006 | De Grys |

OTHER PUBLICATIONS

Communication Pursuant to Article 94(3) EPC Dated Feb. 3, 2016 From the European Patent Office Re. Application No. 07827357.0.

* cited by examiner

LOW-POWER HALL THRUSTER

CROSS REFERENCE TO RELATED APPLICATION

This patent application is based upon and claims the benefit of the filing date of co-pending U.S. Provisional Patent Application Serial No. 60/865,033, filed Nov. 9, 2006, entitled LOW POWER HALL THRUSTER, by the inventors of the present application, which application is incorporated herein in its entirety.

FIELD OF THE INVENTION

Then present invention relates to Hall thrusters. More particularly, the present invention relates to low power Hall thruster effective for micro-spacecrafts and nano-spacecrafts.

BACKGROUND OF THE INVENTION

Hall thrusters were developed and studied in the past 40-45 years, till 1992—mainly in the former Soviet Union and after 1992—in the west as well. Over 200 Hall thrusters have been flown on Soviet or Russian satellites in the last thirty years. This technology was used on the European Lunar mission SMART-1 and is used on a number of commercial geostationary satellites.

A worldwide effort is presently being invested in the developments of micro- and nano-spacecraft propelled using advanced electric propulsion engines. The evaluations and experiments carried out up to now show that attempts to solve this problem face considerable difficulties, which had not yet been overcome (reviews are attached herein as references: "Micropropulsion for Small Spacecraft"/Edited by M. M. Micci and A. D. Ketsdever, *Progress in Astronautics and Aeronautics*, vol. 187, 477 p., 2000.

Among the electric rocket engines that are considered as the candidates for application on micro- and nano-spacecraft, Hall thrusters occupy a prominent place. This is due to the following factors:

1. At large and moderate powers, Hall thrusters possess the highest efficiency at specific impulses of 1200-2500 s, and principal limitations are absent for providing the competitiveness of the thrusters of this type at significantly higher specific impulses;
2. Owing to intensive investigations over a long period of time, the physics of Hall thruster has been clarified to a greater degree than other plasma engines. This fact leads to search for ways of building effective thrusters of small power a noticeably easier problem.

However, in the case of Hall thruster, operation at powers of 50-250 W, as needed to propel micro- and nano-spacecraft, leads to such strong lifetime limitations, raising doubts upon the possibility of creating small power Hall thrusters with high performance using a conventional design.

SUMMARY OF THE INVENTION

It is an object of the present invention to provide a novel low power Hall thruster capable of increasing the efficiency and specific impulse of small power Hall thrusters.

It is yet another object of the present invention to provide a novel low power Hall thruster capable of relatively high lifetime without reducing the efficiency.

1. Therefore, it is provided in accordance with a preferred embodiment of the present invention a Hall thruster comprising:
   - a co-axial acceleration channel capable of being applied with predominantly radial magnetic field wherein ions are accelerated with the applied electric field;
   - a co-axial anode with a cavity therein capable of being applied with a substantially longitudinal magnetic field, wherein the anode is positioned at one end of said co-axial acceleration channel;
   - a cathode-compensator, placed at a second end of said co-axial acceleration channel;
   - a magnetic system capable of generating said radial magnetic field within said co-axial acceleration channel and said longitudinal magnetic field within said co-axial anode;
   - a gas distributor electrically isolated from said co-axial anode, said cathode-compensator and said magnetic system and wherein said gas distributor is placed before said anode.

Furthermore and in accordance with another preferred embodiment for the present invention, said magnetic system comprises magnetic circuit, magnetic poles, and magnetic coils.

Furthermore and in accordance with another preferred embodiment for the present invention, said magnetic system comprises having magnetic circuit, magnetic poles, and permanent magnets.

Furthermore and in accordance with yet another preferred embodiment fog the present invention, said magnetic system comprises magnetic circuit, magnetic poles and combined magnetic coils and permanent magnets.

Furthermore and in accordance with another preferred embodiment for the present invention, surfaces of said co-axial anode are substantially parallel to the longitudinal axis of the Hall thruster with possible deviation within 20°.

Furthermore and in accordance with another preferred embodiment for the present invention, the magnetic field in the cavity of the anode is parallel to an adjacent surface of the anode.

Furthermore and in accordance with another preferred embodiment for the present invention, said longitudinal magnetic field in the anode cavity is created by special magnetic coils with mutually opposite electric currents and magnetic screens, and wherein the magnetic field is regulated independently of said radial magnetic field in said acceleration channel.

Furthermore and in accordance with another preferred embodiment for the present invention, said longitudinal magnetic field within the anode cavity is created with permanent magnets.

Furthermore and in accordance with another preferred embodiment for the present invention, the length of said co-axial anode is predetermined in accordance with the mass flow rate density in the anode cavity.

Furthermore and in accordance with another preferred embodiment for the present invention, the length of said co-axial anode is regulated by placing said gas distributor in a needed point at the anode cavity.

BRIEF DESCRIPTION OF THE FIGURES AND THE INVENTION

In order to better understand the present invention and appreciate its practical applications, the following Figures are attached and referenced herein. Like components are denoted by like reference numerals.

It should be noted that the figures are given as examples and preferred embodiments only and in no way limit the scope of the present invention as defined in the appending Description and claims.

FIG. 1 illustrates a low power Hall thruster provided with co-axial magneto-isolated longitudinal anode in accordance with a preferred embodiment of the present invention.

Figure 2:
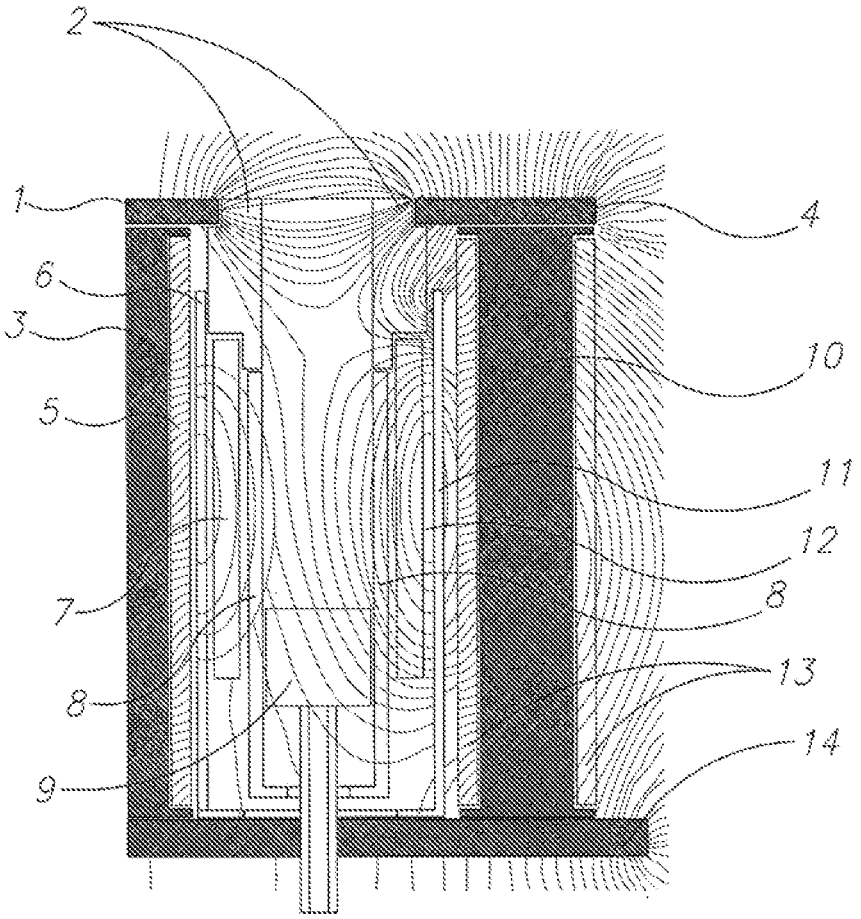

FIG. 2 schematically illustrates magnetic field lines configuration, calculated for a chosen CAMILA magnetic circuit, in accordance with a preferred embodiment of the present invention. The maximal value of the radial component of the magnetic field induction in the acceleration channel is 0.013 T; the maximal value of the longitudinal component of the magnetic induction in the anode cavity is 0.016 T.

Figure 3:
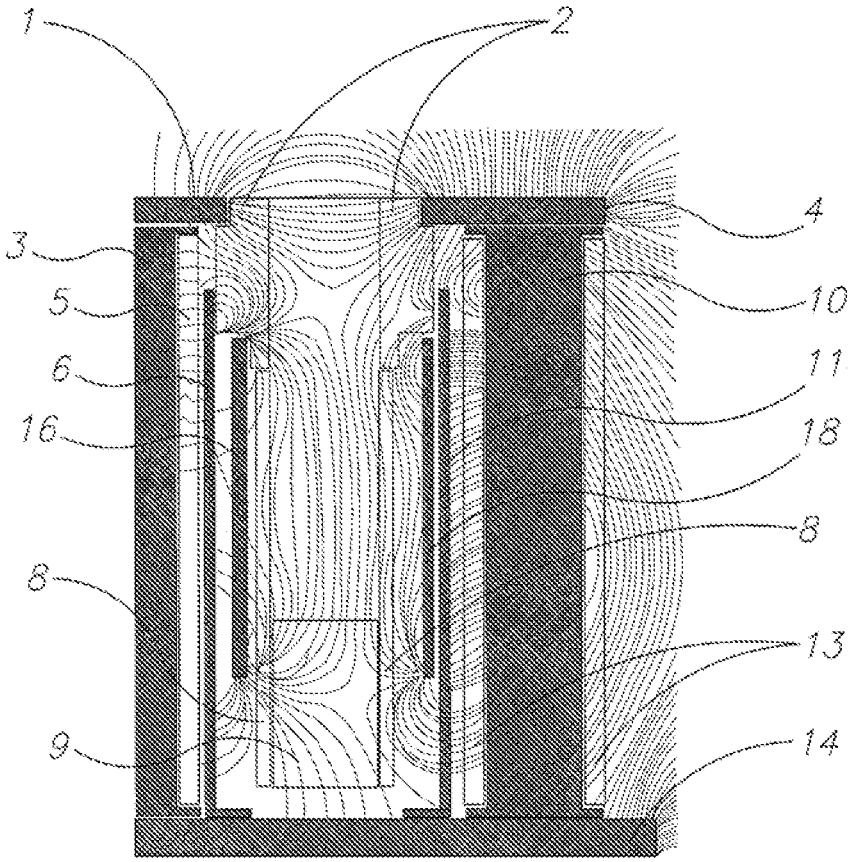

FIG. 3 illustrates magnetic filed lines in a combined magnetic system in accordance with yet another preferred embodiment of the present invention.

Figure 4A:
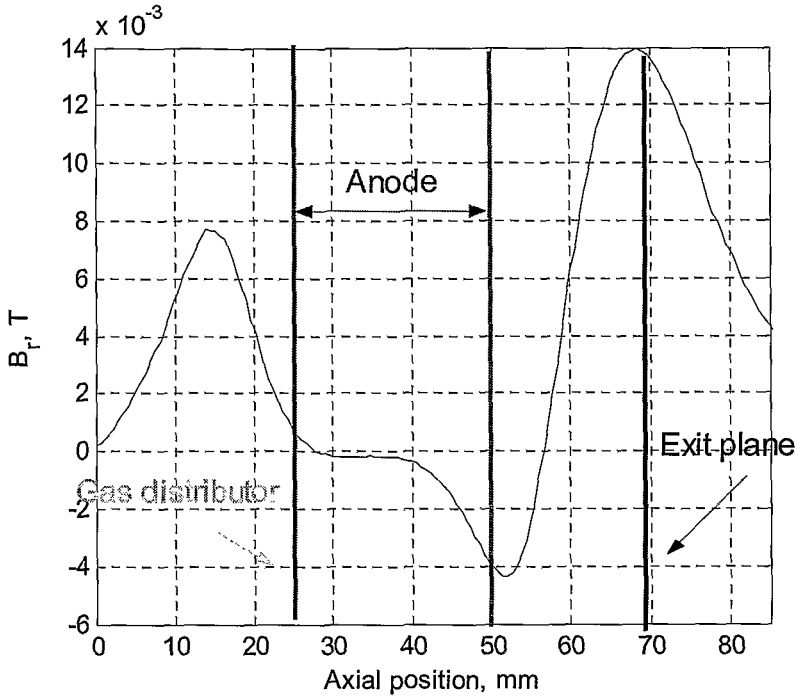
Figure 4B:
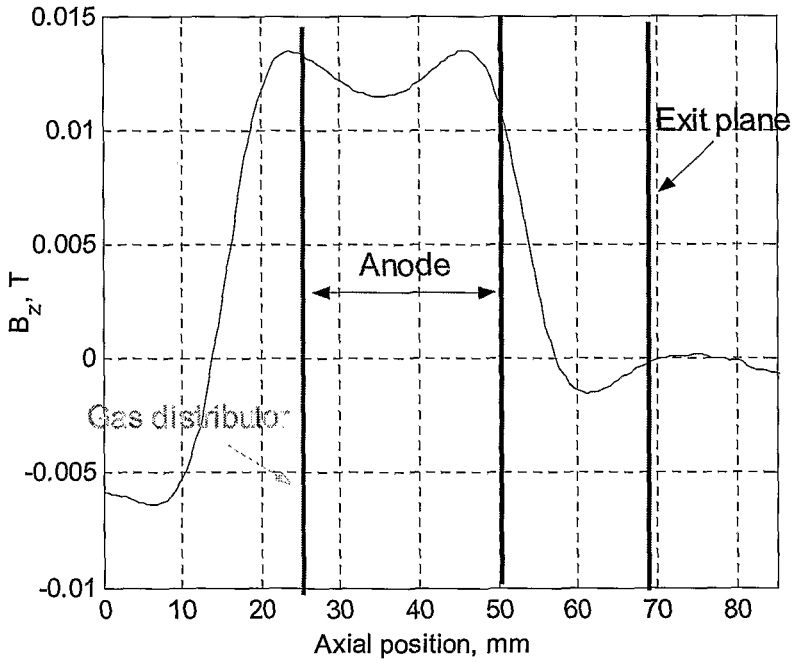
Figure 4C:
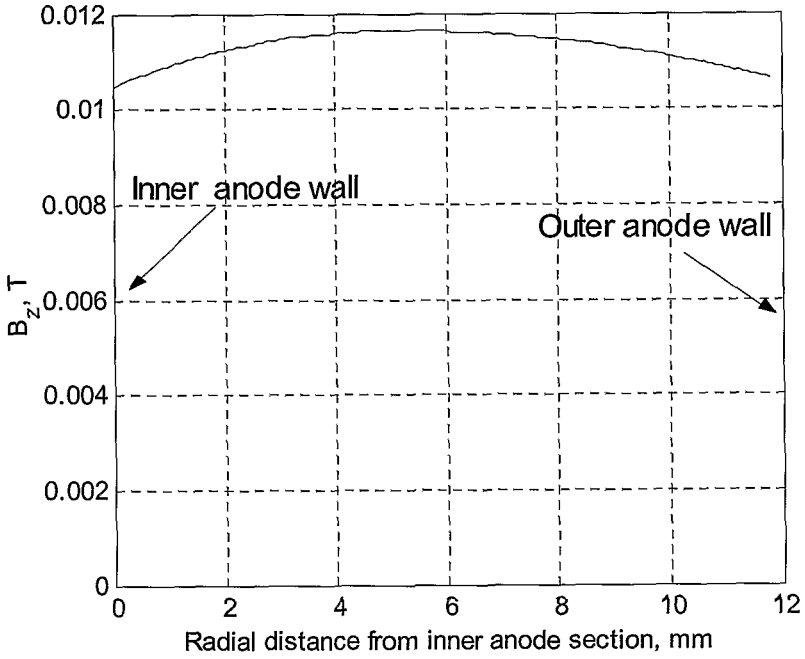

FIGS. 4*a-c* illustrate profiles of magnetic fields calculated for the magnetic circuit shown in FIG. 3, of the radial and longitudinal magnetic field components.

Figure 5:
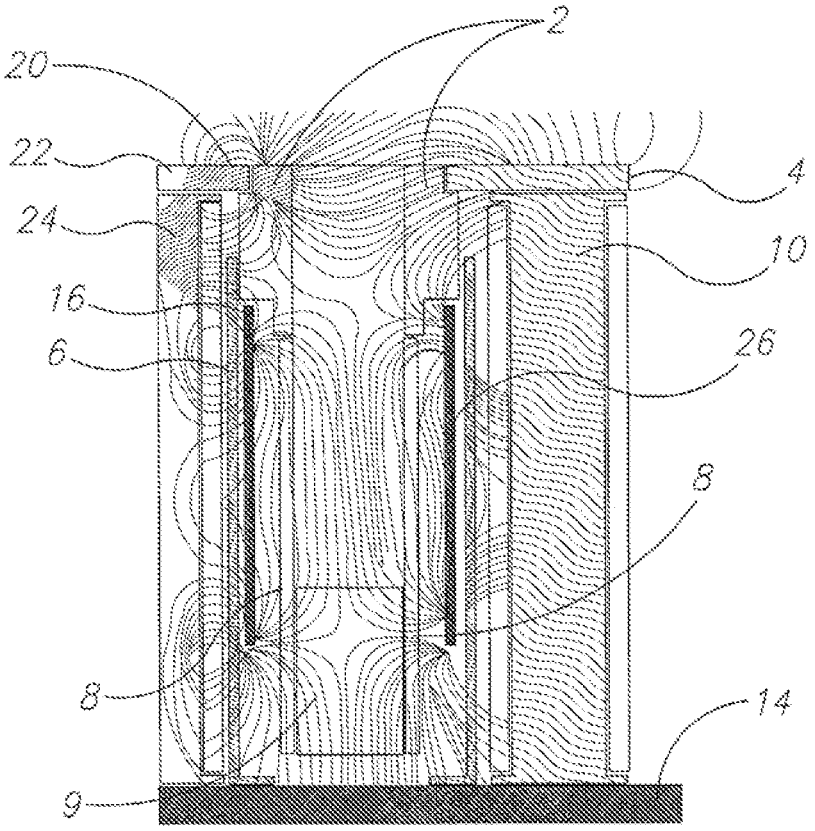

FIG. 5 illustrates magnetic field lines of a Hall thruster provided with permanent magnets in accordance with an additional embodiment of the present invention.

Figure 6A:
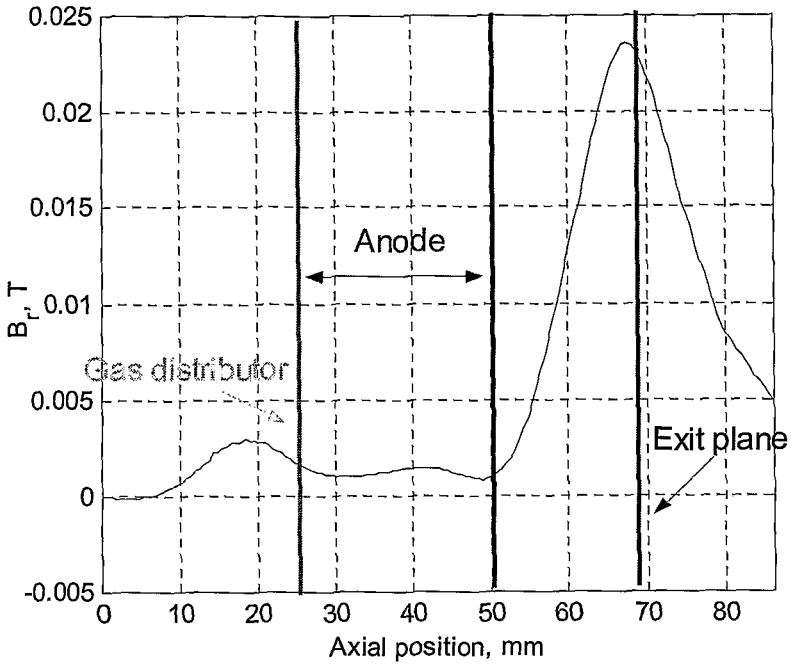
Figure 6B:
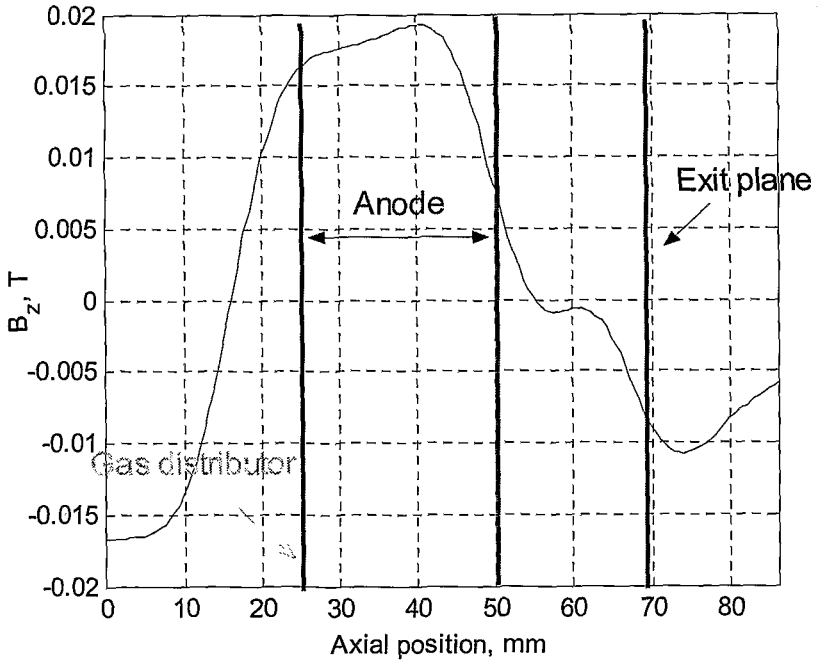
Figure 6C:
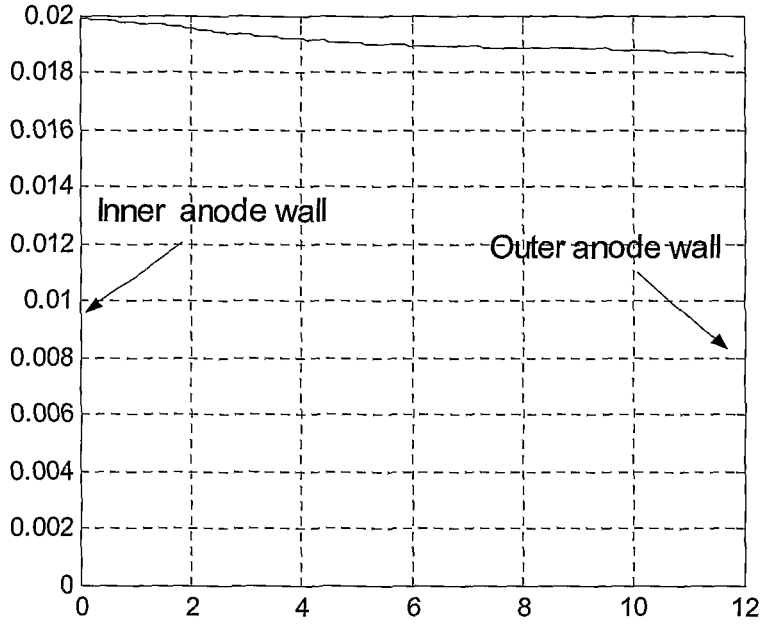

FIGS. 6*a-c* illustrate profiles of magnetic fields calculated for the magnetic circuit shown in FIG. 5, of the radial and longitudinal magnetic field components.

DETAILED DESCRIPTION OF THE FIGURES AND THE INVENTION

The present invention provides a novel low power thruster that is provided with a co-axial magneto-isolated longitudinal anode configured to overcome the limitations in such low power Hall thrusters involved in steady state operation. The co-axial magneto-isolated longitudinal anode concept of the present invention intends to solve the problem of propellant ionization in the low-power Hall thruster by means of aa ionization area extension along with the prevention of ion losses on its walls.

Reference is now made to FIG. 1 illustrating a low power Hall thruster provided with co-axial magneto-isolated longitudinal anode in accordance with a a preferred embodiment of the present invention. The abbreviation of co-axial magneto-isolated longitudinal anode is CAMILA and therefore, in this description, co-axial magneto-isolated longitudinal anode and CAMILA will be alternately used. The preferred embodiment of CAMILA Hall thruster comprises a magnetic system consisting of basic magnetic field coils 100 and anode magnetic coils 122, central magnetic pole 102, magnetic flange 104, magnetic screens 106, and magnetic circuit 118. CAMILA Hall thruster also comprises co-axial acceleration channel 124, an anode 126, a gas distributor 128 and cathode-compensator 130. Basic magnetic lines are represented by doted lines 132.

One of the primary features of the CAMILA Hall thruster magnetic system is the mostly longitudinal magnetic field in the ionization zone that is located in an anode cavity 120, and mostly radial magnetic field in the acceleration zone 124 near the thruster exit plane. The minimal required value of the longitudinal component of the magnetic field induction in the ionization region is about 0.002 T and depends on the width of the anode cavity. The effectiveness of the propellant ionization in the anode cavity should increase at increasing the induction of the longitudinal magnetic field, according to evaluation that was done by the inventors of the present invention. The magnetic field topography in the anode cavity 120 should be substantially close to symmetric relative to the central surface of the cavity. In the acceleration region, the requirements to the magnetic field configuration and the value of the magnetic induction are the same, to a first approximation, as in common Hall thrusters: symmetry relative to the channel central surface and, which is essential, high positive axial gradient. At large values of the induction of the longitudinal magnetic field in the anode cavity the magnitude of the radial component of the magnetic field induction in the acceleration region can be reduced compared to the conventional Hall thruster. The reduced values of the radial component of the magnetic field can be used as a consequence of the specific feature of the CAMILA Hall thruster. As distinguished from the conventional Hall thruster, in the CAMILA Hall thruster there is more than one "barrier" for the electrons on their way towards the anode. The first barrier is the radial magnetic field in the acceleration region, and the second barrier is the longitudinal magnetic field in the anode cavity.

Reference is now made to FIG. 2 schematically illustrating the magnetic field lines configuration for a chosen CAMILA magnetic circuit in accordance with a preferred embodiment of the present invention. The maximal, value of the radial component of the magnetic field induction in the acceleration channel is 0.013 T; the maximal value of the longitudinal component of the magnetic induction in the anode cavity is 0.016 T. The main parts of the magnetic system are the inner and outer coils, inner and outer magnetic pole pieces, inner and outer magnetic screens and magnetic flange. These parts are common to Hall thrusters. The specific features of the CAMILA thruster are the inner and outer magnetic coils, placed between the magnetic screens close to the anode. The aim of these coils is to create mostly a longitudinal magnetic field in the anode cavity. The parts of the CAMILA thruster are represented in FIG. 2 according to the numerals: 1—Inner magnetic pole, 2—Ceramic acceleration channel walls, 3—Central magnetic core, 4—Outer magnetic pole, 5—Inner coil, 6—Inner magnetic screen, 7—Inner anode coil, 8—Anode, 9—Gas distributor, 10—Outer magnetic core, 11—Outer magnetic screen, 12—Outer anode coil, 13—Outer coil, 14—Magnetic system back-plate.

Optionally and in addition to the basic magnetic system, the possibility of using strong permanent magnets instead of anode coils to create the magnetic field in the anode cavity was checked. The permanent magnets are capable of creating high field values and do not require power supply. The results of the calculations show that it is possible to create the required magnetic field configuration in the CAMILA thruster using a combination of the magnetic coils and permanent magnets.

Reference is now made to FIG. 3 illustrating magnetic filed lines in a combined magnetic system in accordance with yet another preferred embodiment of the present invention. The parts of the CAMILA Hall thruster is represented by the following numerals: 1—Inner magnetic pole, 2—Ceramic acceleration channel walls, 3—Central magnetic core, 4—Outer magnetic pole, 5—Inner coil, 6—Inner magnetic screen, 16—Permanent magnet, 8—Anode, 9—Gas distributor, 10—Outer magnetic core, 11—Outer magnetic screen, 18—Permanent magnet, 13—Outer coil, 14—Magnetic system back-plate.

Reference is now made to FIGS. 4*a-c* illustrating profiles of magnetic fields calculated for the magnetic circuit shown in FIG. 3, of the radial and longitudinal magnetic field components. The axial profiles of the radial and longitudinal components of the magnetic field on the channel central surface are shown in FIGS. 4*a* and 4*b*, respectively. The radial profile of the longitudinal component of the magnetic field in the middle of the anode is presented in FIG. 4*c*.

Optionally and in accordance with yet another preferred embodiment of the present invention, all magnetic coils in the Hall thruster can be replaced by permanent magnets. The anode coils, as in the previous case were replaced by the permanent magnets. In addition, the part of the inner magnetic pole piece was also replaced by a permanent magnet. The analysis demonstrated that it is possible to create appropriate magnetic field configuration using only permanent magnets.

Reference is now made to FIG. 5 illustrating magnetic field lines of a Hall thruster provided with permanent magnets in accordance with an additional embodiment of the present invention. The parts of the Hall thruster are represented by the numerals as follows: 20—Permanent magnet, 2—Ceramic acceleration channel walls, 22—Inner magnetic pole, 4—Outer magnetic pole, 24—Central magnetic core, 6—Inner magnetic screen, 16—Permanent magnet, 8—Anode, 9—Gas distributor, 10—Outer magnetic core, 26—Permanent magnet, 14—Magnetic system backplate.

Reference is now made to FIGS. 6*a-c* illustrating profiles of magnetic fields calculated for the magnetic circuit shown in FIG. 5, of the radial and longitudinal magnetic field components. The axial profiles of the radial and longitudinal components of the magnetic field on the channel central surface are given in FIGS. 6*a* and 6*b*, respectively. The radial profile of the longitudinal component of the magnetic field in the middle of the anode is presented in FIG. 6*c*.

It should be noted that CAMILA differs from the conventional Hall thruster in two main aspects:

1) The working anode surface is positioned parallel to the thruster axis, but not transverse to it. This surface is preferably formed from two co-axial metallic cylinders. Their length is chosen in accordance to the mass flow rate density of the propellant in the anode cavity. The lesser the density, the bigger the length of the cylinder.
2) In the anode cavity, the longitudinal magnetic field with an induction not less than 0.002 T is applied. In the thruster, as shown in FIG. 1, the longitudinal magnetic field is created by two additional anode coils with opposite directions of the currents. This field can be created by permanent magnets as well, as shown in the optional embodiments.

In order to understand the operation of the CAMILA Hall thruster, reference is made again to FIG. 1. The CAMILA Hall thruster operates in the following manner. The propellant, which is preferably a xenon gas, is fed in anode cavity 120 through gas distributor 128, which is electrically isolated from the anode, cathode-compensator and magnetic system and is under floating potential. In anode cavity 120, the atoms of the xenon are ionized by the electrons of the anode plasma. The electrons and ions, arisen as a result of the ionization of the propellant, go to the anode surface and to the exit of the cavity, respectively. After leaving anode cavity 120, the ions are accelerated by the longitudinal electric field in acceleration channel 124. The direction of electric field E in the channel and anode cavity is shown by arrows. The presence of a radial component of the electric field in the ionization area is a consequence of the application of the co-axial magneto-isolated longitudinal anode, proposed in the invention, instead of the conventional one. The radial component of the electric field in the anode cavity, in turn, does not permit the ions to attain the surface of the anode and disappear there. This is the reason of potentially high efficiency of the CAMILA Hall thruster. The electric field is created by the voltage, applied between anode 126 and cathode-compensator 130. The space charge of the ions in acceleration channel 124 is neutralized by the electrons, drifting in the mutually perpendicular fields—radial magnetic and longitudinal electric fields. Beyond the channel, the flow of the fast ions is compensated by the electron current from cathode-compensator 130.

It should be clear that the description of the embodiments and attached Figures set forth in this specification serves only for a better understanding of the invention, without limiting its scope as covered by the following claims.

It should also be clear that a person skilled in the art, after reading the present specification can make adjustments or amendments to the attached Figures and above described embodiments that would still be covered by the following claims.

The invention claimed is:

1. A Hall thruster comprising:

an acceleration channel extending along an axial direction having a first end arid a second end opposite to each other;

an elongated anode extending along the axial direction positioned at said first end of said acceleration channel, said anode comprising working surfaces of two coaxial cylinders defining a cavity between said working surfaces and an exit for ions moving towards said acceleration channel predominantly along the axial direction with respect to said cylinders, wherein an electric field formed in said cavity has a radial component directed to prevent the ions in said cavity from attaining said working surfaces of said cylinders;

a cathode-compensator, placed at said second end of said acceleration channel;

a magnetic system generating a predominately radial magnetic field within said acceleration channel and a predominantly longitudinal magnetic field within said cavity of said anode; and a gas distributor, placed in said cavity of said anode between said working surfaces, opposite to said exit, and being electrically isolated from said anode, said cathode-compensator and said magnetic system.

2. The Hall thruster as claimed in claim 1, wherein said magnetic system comprises magnetic circuit, magnetic poles, and magnetic coils.

3. The Hall thruster as claimed in claim 1, wherein said magnetic system comprises magnetic circuit, magnetic poles, and permanent magnets.

4. The Hall thruster as claimed in claim 1, wherein said magnetic system comprises magnetic circuit, magnetic poles and combined magnetic coils and permanent magnets.

5. The Hall thruster as claimed in claim 1, wherein said working surfaces of said anode are substantially parallel to a longitudinal axis of the Hall thruster with possible deviation within plus to minus 20°.

6. The Hall thruster as claimed in claim 5, wherein the longitudinal magnetic field in the cavity of the anode is parallel to an adjacent surface of the anode.

7. The Hall thruster as claimed in claim 1, wherein said longitudinal magnetic field in the cavity of said anode is created by special magnetic coils with mutually opposite electric currents and magnetic screens, and wherein the longitudinal magnetic field is regulated independently of said radial magnetic field in said acceleration channel.

8. The Hall thruster as claimed in claim 1, wherein said longitudinal magnetic field within the cavity of said anode is created with permanent magnets.

9. The Hall thruster as claimed in claim 1, wherein said anode is generally isolated magnetically such that a value of a longitudinal component of a magnetic induction therein is 0.002-0.016 T.

10. The Hall thruster as claimed in claim 1, wherein said anode is generally isolated magnetically such that a value of a radial component of a magnetic induction therein is at most 0.013 T.

11. The Hall thruster as claimed in claim 1, wherein said anode is generally isolated magnetically such that a value of a longitudinal component of a magnetic induction therein is at most 0.016 T. and a value of a radial component of the magnetic induction therein is at most 0.013 T.

12. The Hall thruster as claimed in claim 1, wherein said anode is arranged such that the ions generated in said cavity exit, generally longitudinally, towards said acceleration channel.

* * * * *